United States Patent [19]

Hodgson

[11] 3,947,811

[45] Mar. 30, 1976

[54] FAULT INDICATING SYSTEMS IN VEHICLES

[75] Inventor: Duncan Barry Hodgson, Whitnash near Leomington Spa, England

[73] Assignee: The Lucas Electrical Company Limited, Birmingham, England

[22] Filed: Sept. 26, 1974

[21] Appl. No.: 509,552

[52] U.S. Cl. ..... 340/52 F; 340/183; 340/324 R; 340/413

[51] Int. Cl.[2] ..... G08B 19/00

[58] Field of Search ..... 340/52 F, 412, 413, 415, 340/183, 181, 324; 307/9, 10 R

[56] References Cited

UNITED STATES PATENTS

| | | | |
|---|---|---|---|
| 3,651,454 | 3/1972 | Venema et al. | 340/52 F |
| 3,835,450 | 9/1974 | Reck | 340/412 X |
| 3,846,639 | 11/1974 | Veda et al. | 340/52 F X |

*Primary Examiner*—Alvin H. Waring
*Attorney, Agent, or Firm*—Olson, Trexler, Wolters, Bushnell & Fosse, Ltd.

[57] ABSTRACT

A fault indicating system in a vehicle includes a d.c. source, a plurality of electrically operated devices operated by the d.c. source and a plurality of fault indicating units, one for each device. Each fault indicating unit is operable by a predetermined address signal, and on being operated produces after a delay an output representative of the operation condition of its device, each fault indicating unit having a different delay. A monitoring unit produces the predetermined address signal and receives the output signals from the fault indicating units. The monitoring unit operates in cycles, in each of which it has a transmission period in which it feeds the address signal to all the fault indicating units, and a plurality of receiving periods during which it receives the output signals from the fault indicating units in turn, warning means being operable by the monitoring unit to indicate a fault in any of the devices.

2 Claims, 1 Drawing Figure

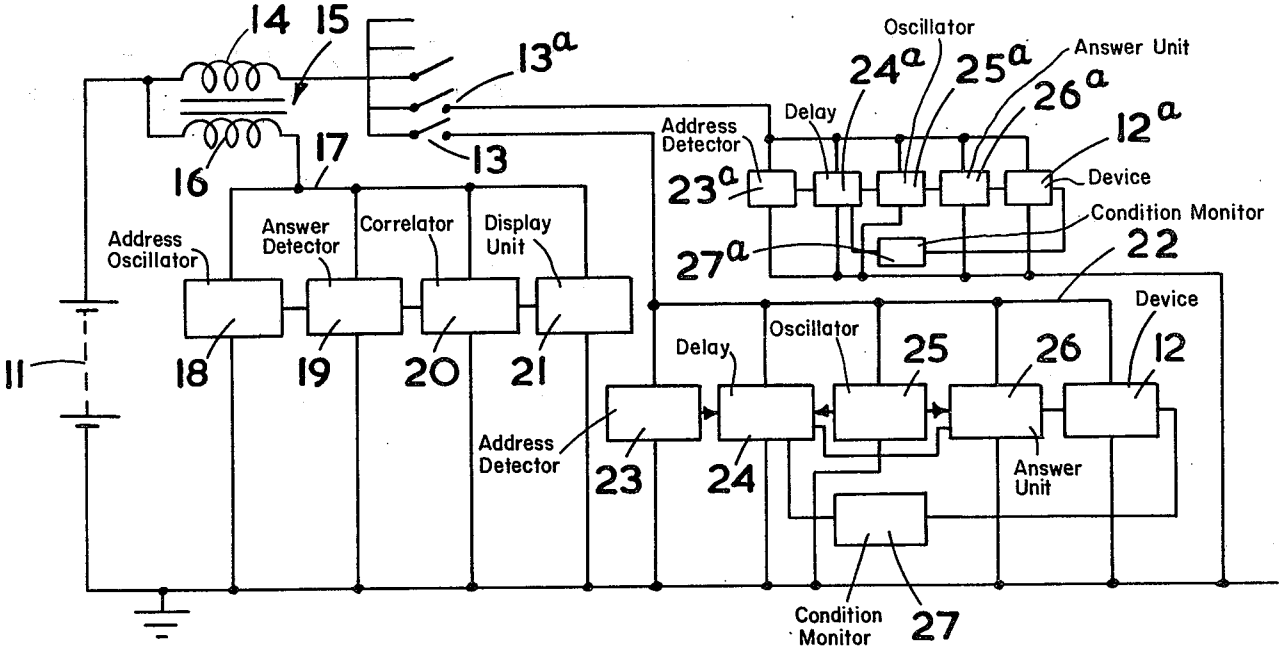
Answer Unit
Oscillator
Delay
Address Detector
Device
Condition Monitor
Display Unit
Correlator
Answer Detector
Address Oscillator
Device
Answer Unit
Oscillator
Delay
Address Detector
Condition Monitor
12a
26a
25a
24a
23a
27a
22
12
26
25
24
23
27
21
20
19
18
13a
13
15
14
16
17
11

FAULT INDICATING SYSTEMS IN VEHICLES

This invention relates to fault indicating systems in vehicles, particularly road vehicles.

A system according to the invention includes a d.c. source, a plurality of electrically operated devices operated by said d.c. source, a plurality of fault indicating units, one for each device, each fault indicating unit being operable by a predetermined address signal, and on being operated producing after a delay an output representative of the operational condition of its device, each fault indicating unit having a different delay, a monitoring unit for producing said address signal and receiving said output signals, said monitoring unit operating in cycles, in each of which it has a transmission period in which it feeds the address signal to all the fault indicating units, and a plurality of receiving periods during which it receives the output signals from the fault indicating units in turn, and warning means operable by the monitoring unit to indicate a fault in any of the devices.

Preferably, each receiving period is in two parts. Receipt of a signal during the first and second parts indicates respectively satisfactory operation and the need for attention, the absence of a signal during both the first and second parts indicate failure of the device.

In the preferred arrangement, the monitoring unit feeds the address signal to the fault indicating units, and receives the outputs from the fault indicating units, by way of the supply leads from the battery to the devices. The address signal is preferably in the form of a burst of pulses of frequency such that no radio or other interference is produced, and of length such that the address signal cannot be confused with any extraneous signals in the system.

The accompanying drawing is a circuit diagram illustrating one example of the invention.

Referring to the drawing, a vehicle battery 11 has its negative terminal earthed, and supplies power in the usual way to all the electrically operated devices on the vehicle. Two such devices are indicated at 12 and 12*a*, and are connected to the positive terminal of the battery through switches 13 and 13*a*. However, some of the devices may be connected to the battery through more than one switch, or directly.

Between the battery and the switches 13, 13*a* is the primary winding 14 of a current transformer 15, the secondary winding 16 of which has one end connected to the positive terminal of the battery, and its other end connected to a supply line 17. Connected between the supply line 17 and earth are an address oscillator 18, an answer detector 19, a correlator 20, and a display unit 21.

The switch 13 supplies power to a line 22, the device 12 being connected between the line 22 and earth. Also connected between the line 22 and earth are an address detector 23, a preset delay network 24, an oscillator 25, and an answer unit 26. The device 12 provides an output to a condition monitor 27 which varies the delay provided by the unit 24. Each of the devices 12 has a similar set of components associated therewith, those associated with the device 12*a* being indicated with the same reference numerals as those associated with the device 12, but with the suffix *a*.

The normal electrical system of the vehicle is unaffected by the fault indicating system, and operates in a conventional manner. However, in addition to the normal current flow in the various parts of the system, the fault indicating system superimposes an alternating wave form consisting of a burst of pulses of predetermined frequency and length provided by the oscillator 18. This burst of pulses is fed by way of the transformer 15 to the various supply lines, and is received by each of the detectors 23, 23*a*. It will of course be appreciated that the components 23 to 27 associated with the device 12 constitute a fault indicating unit, whilst the components 18 to 21 constitute a monitoring unit. The monitoring unit operates in a cycle starting with the production of the burst of pulses for a period of time referred to as the transmission period. The remainder of the cycle is then divided into a plurality of receiving periods, the number of receiving periods being equal to the number of devices 12, 12*a* being monitored. During the transmission period, the detector 23 receives the signal from the oscillator 18, the detector 23 including a frequency-sensitive filter to ensure that it is only operated by the address signal. On receipt of the signal, the detector 23 operates an answer unit 26 after a fixed delay determined by the unit 24. For the sake of explanation, assume that there are nine devices 12 being monitored, then the cycle of operation of the oscillator 18 is in ten parts, the first of which is a transmission period, and the following nine of which are receiving periods. The delay inserted into the system by the unit 24 is such that the answer unit 26 is capable of producing an output on the line 22 during the first receiving period. During this period, the answer detector 19 receives the signal transmitted by the unit 26, but the time during the first receiving period at which the signal is received by the detector 19 is determined by the condition of the device 12. The receiving period can be considered in three parts. If the device 12 is operating satisfactorily, the monitor 27 introduces no further delay, and the signal is received by the detector 19 during the first part of the first receiving period. If the device 12 is faulty, then the monitor 27 imposes such a delay that the unit 26 produces no output whatsoever during the first receiving period, and the detector 19 recives no signal. If the device 12 requires attention, then the monitor 27 imposes a delay such that the unit 26 produces an output during the second part of the first receiving period. The correlator 20 ensures that the display unit 21 indicates the condition of the device being monitored during a given receiving period.

The fault indicating unit associated with the device 12*a* operates in the same way, except of course that the delay unit 24*a* introduces a longer delay so that a signal is received back from the answer unit 26*a* by way of the transformer 15 during the second receiving period. The other fault indicating units all have different delays so that the answer detector 19 receives replies from the fault detector units in turn during the cycle.

In many cases it will not of course be possible to give one of three signals, but the system can readily be used in a two-state mode indicating whether a device is functioning or not functioning.

The detector 19 is preferably a transformer detecting current, or volttage, on the line 17, and each answer unit 26 may simply be an extra load connected between its line 22 and earth. Although in the example shown the signals are fed along the normal supply lead, a special lead could be used for this purpose.

The type of address detector 23 used will depend upon the load being monitored, but in the case of a lamp, can simply be a winding of a transformer in series with the lamp. Current will flow through the winding if the lamp is operating satisfactorily, but no current will flow if the lamp has broken. The oscillators 18, 25 may take the form of unijunction timers, each including a capacitor which is charged and then turns on a unijunction transistor.

The pre-set delay may conveniently be formed by a counter which is pre-set to a different value for each of the devices being monitored. The condition of the device may also be used to modify the pre-set number. A clock signal is conveniently constituted, where a counter is used, by the local oscillator 25. In such an arrangement, when the address signal is recognised, then the counter is pre-set to a number determined by the particular device being monitored and by the state of that device. The counter then counts the local oscillator until an output occurs, that is the counter has counted a number of cycles of the local oscillator and hence produced a time delay.

The condition monitor 27 will have a form dependent on the particular device being monitored, but as one example, in the case of a bulb the monitor 27 could simply indicate that a bulb has failed, so that the address signal is not detected and no answer is given. As a second example, fluid levels may be detected by float switches, one of which can be designated a warning level switch and the other a danger level switch. It will be appreciated that such a pair of switches could be used to give one of two answers depending on whether attention is needed, or a dangerous situation exists.

The answer detector 19 also has to generate information to determine which of the devices is giving an answer. The circuit between the line 17 and earth generates a series of delays equal to those of each of the delay circuits 24 and opens a gate at each delay period. The oscillator 18 output is fed into a counter, the counter steps on and the output of a decoder moves on in sequence to open each gate in turn. The information at the gate can indicate whether the display device at 21 should be activated and also the state of the device being monitored. An output can be made to occur if no answer signal is received during the period when an appropriate gate is opened and if intermediate signals are required indicating need for attention.

I claim:

1. A fault indicating system in a vehicle including a d.c. source, a plurality of electrically operated devices operated by said d.c. source, a plurality of fault indicating units, one for each device, each fault indicating unit being operable by a predetermined address signal and, on being operated, producing after a delay an output representative of the operational condition of its associated device, each fault indicating unit having a different delay, a current transformer having its primary winding connected to said devices and said fault indicating units, a monitoring unit for producing said address signal and receiving said output signal, said monitoring unit operating in cycles, in each of which it has a transmission period in which it feeds the address signal to all the fault indicating units by way of the supply leads from the d.c. source to said devices, and a plurality of receiving periods during which it receives the output signals from said fault indicating units in turn by way of said supply leads, and warning means operable by the monitoring unit to indicate a fault in any of said devices, said warning means and said monitoring unit being connected to the secondary winding of said current transformer.

2. A fault indicating system in a vehicle including a d.c. source, a plurality of electrically operated devices operated by said d.c. source, a plurality of fault indicating units, one for each device, each fault indicating unit being operable by a predetermined address signal and, on being operated, producing after a delay an output representative of the operational conditon of its associated device, each fault indicating unit having a different delay, a monitoring unit for receiving said output signals and for producing said address signal in the form of a burst of pulses of a frequency such that no radio or other interference is produced, and of a length such that the address signal cannot be confused with any extraneous signals in the system, said monitoring unit operating in cycles, in each of which it has a transmission period in which it feeds the address signal to all the fault indicating units, and a plurality of receiving periods during which it receives the output signals from the fault indicating units in turn, and warning means operable by the monitoring unit to indicate a fault in any of the devices.

* * * * *